US006516584B1

(12) United States Patent
Rudd

(10) Patent No.: US 6,516,584 B1
(45) **Date of Patent: *Feb. 11, 2003**

(54) ADDITIONAL METAL WOOD COMPOSITE FRAMING MEMBERS FOR RESIDENTIAL AND LIGHT COMMERCIAL CONSTRUCTION

(76) Inventor: Armin Rudd, 4615 Janet Rd., Cocoa, FL (US) 32926

( * ) Notice: Subject to any disclaimer, the term of this patent is extended or adjusted under 35 U.S.C. 154(b) by 0 days.

This patent is subject to a terminal disclaimer.

(21) Appl. No.: 09/633,219

(22) Filed: Aug. 7, 2000

Related U.S. Application Data

(62) Division of application No. 09/248,622, filed on Feb. 11, 1999, now Pat. No. 6,250,042, which is a continuation-in-part of application No. 08/975,437, filed on Nov. 21, 1997, now Pat. No. 5,881,529, and a continuation-in-part of application No. 08/975,642, filed on Nov. 21, 1997, now Pat. No. 5,875,603, and a continuation-in-part of application No. 08/976,107, filed on Nov. 21, 1997, now Pat. No. 5,875,604, and a continuation-in-part of application No. 08/976,151, filed on Nov. 21, 1997, now Pat. No. 5,875,605, and a continuation-in-part of application No. 08/974,898, filed on Nov. 21, 1997, now Pat. No. 5,921,054, each is a division of application No. 08/664,662, filed on Jun. 21, 1996, now abandoned.

(51) Int. Cl.[7] ..... E04L 3/30

(52) U.S. Cl. ..... 52/731.8; 52/376; 52/730.7; 52/731.9; 52/733.3; 52/736.1; 52/737.3; 52/765

(58) Field of Search ..... 52/376, 261, 461.1, 52/730.1, 730.7, 731.1, 731.8, 731.9, 733.3, 736.1, 737.3, 765, 699

(56) References Cited

U.S. PATENT DOCUMENTS 3,310,324 A 3/1967 Boden
3,531,901 A 10/1970 Will, Jr. et al.
3,566,569 A 3/1971 Coke et al.
3,960,637 A 6/1976 Ostrow
4,031,686 A 6/1977 Sanford
4,274,241 A 6/1981 Lindal
4,281,497 A 8/1981 Luotonen et al.
4,301,635 A 11/1981 Neufeld
4,466,225 A 8/1984 Hovind
4,738,071 A * 4/1988 Ezard ..... 52/741
4,875,316 A 10/1989 Johnston
5,024,039 A 6/1991 Karhumaki
5,072,547 A 12/1991 Difazio
5,280,692 A 1/1994 Patey
5,285,615 A 2/1994 Gilmour (List continued on next page.)

*Primary Examiner*—Yvonne M. Horton

(57) ABSTRACT

Metal and wood composites are used to create framing members (studs and tracks, joists and bands, rafters, headers and the like), for lightweight construction. Metal is utilized for its high strength, resistance to rot and insects, cost stability, and potentially lower cost through recycling. Metal that can be used includes roll formed steel approximately 18–22 gauge. Wood is used primarily for its lower thermal conductivity, and availability. The metal components form the primary structure while wood, either solid or other engineered wood, provides some structure and a thermal break. A central web board can have a length of approximately 8 feet or longer with metal forms running along each of the longitudinal side edges of the board. A first embodiment metal-wood stud member has adhesive pocket end configurations. A second embodiment is a metal-wood top and bottom track having an adhesive pocket configuration. A third embodiment is a metal-wood stud having P-shape end configurations. The wood is fastened to the metal by machine pressing of the metal to wood. Alternatively the fastening includes nails, staples, screws, and the like, and also by adhesive glue. The outward faces of the metal members can be pre-formed with four longitudinal v-shaped or rounded edge ridges such that the contact surface area to applied sheathings is reduced by about 90%.

14 Claims, 10 Drawing Sheets

U.S. PATENT DOCUMENTS 5,440,848 A 8/1995 Deffet
5,452,556 A 9/1995 Taylor
5,678,381 A * 10/1997 DenAdel ..... 52/730.1
5,768,849 A 6/1998 Blazevic
5,881,520 A 3/1999 Blazevic
5,950,385 A 9/1999 Herren
5,992,125 A * 11/1999 Hardy ..... 52/737.3

* cited by examiner

ADDITIONAL METAL WOOD COMPOSITE FRAMING MEMBERS FOR RESIDENTIAL AND LIGHT COMMERCIAL CONSTRUCTION

This invention relates to composite framing members, more specifically to studs and tracks from metal and wood composites. This invention is a division of Ser. No. 09/248,622 filed Feb. 11, 1999, now U.S. Pat. No. 6,250,042, which is a Continuation-In-Part of U.S. applications Ser. No. 08/974,898 filed Nov. 20, 1997 now Issued as U.S. Pat. No. 5,921,054, Ser. No. 08/975,437 filed Nov. 21, 1997 now Issued as U.S. Pat. No. 5,881,529: Ser. No. 08/975,642 filed Nov. 21, 1997 now Issued as U.S. Pat. No. 5,875,603: Ser. No. 08/976,107 filed Nov. 21, 1997 now Issued as U.S. Pat. No. 5,875,604: Ser. No. 08/976,151 filed Nov. 21, 1997 now Issued as U.S. Pat. No. 5,875,605 which are all divisional applications of Ser. No. 08/664,662 filed Jun. 17, 1996, now abandoned.

BACKGROUND AND PRIOR ART

Residential and light commercial construction generally use wood lumber as the primary building material for studs, plates, joists, headers and trusses. However, wood lumber construction has problems. The rapidly rising cost of raw wood supplies has in effect substantially raised the cost of these members. Further, the quality of available framing lumber continues to decline. Finally, wood is flammable and susceptible to insects and rot.

Due to these problems, many builders have been switching to light gauge steel framing. The costs between using wood or steel framing is getting closer. In January 1990, the cost of framing lumber was about $225 per thousand board feet, peaking to highs of $500 in both January, 1993 and January 1994. Since June 1995, the framing lumber composite price has been rising from $300 per thousand board feet. Estimates from the AISI and NAHB Research Center state at a framing lumber cost of $340 to $385, there would be no difference between the cost of framing a house in steel as compared in wood. Thus, the break-even point between wood and steel framing is at about $360 per thousand board feet of framing lumber, and the lumber price has exceeded that point several times in recent years by as much as 40%, giving steel a competitive advantage.

Recycling has additionally helped the cost of steel to remain on a stable or downward trend. Steel costs have varied little in recent years. Traditionally variations can be correlated to steel demand by the automobile industry, when demand is high, steel usually increases slightly in price. Consequently, the use of metal framing in residential and light commercial construction is increasing, a trend recognized and encouraged by the American Iron and Steel Institute (AISI).

Steel studs, tracks and trusses are commonly manufactured by industry by companies such as Deitrich, Unimast, Alpine, Tri-Chord, HL Stud, Truswall Systems, Techbuilt, Knudson, John McDonald, and MiTek.

A problem with steel framing is its high thermal conductivity, leading to thermal bridging, "ghosting", and greater potential for water vapor condensation on interior wall surfaces. "Ghosting" is when an unsightly streak of dust accumulates on the interior wallboard, where the steel studs lie behind, due to an acceleration of dust particles toward the colder surface. Another problem of using steel framing is the increased energy use for space conditioning (heating and cooling). Metal used for exterior framing members allows greater conduction heat transfer between the outside and inside surfaces of a wall, roof or floor. In colder climates, this increased conduction can cause condensation in interior surfaces, contributing to material degradation and mold and mildew growth. Metal framing also decreases the effectiveness of insulation installed in the cavity between the metal framing due to increased three-dimensional thermal short circuiting effects. Higher sound transmission is another disadvantage of metal framing since sound conductivity is greater in metal than in wood. Electricians have more difficulty working with steel framing for running wiring since its more difficult to cut holes in steel than in wood, and grommets or conduits must be used to protect the wire.

U.S. Pat. No. 5,768,849 to Blazevic describes a "composite structural post", title, having L-shaped metal members on sides of stud members, FIG. 3. However, L-shaped legs are directly connected to the side edges of the wood stud base, and are not structurally wrapped about side edges of the wood stud bases. The orientation of the L shaped legs would not adequately increase the thermal resistance over single wood material stud members, nor have a greater axial load capability over single wood material stud members, nor substantially reduce interior condensation and ghosting. The embodiments covering using cap shaped metal members in FIGS. 6, 6A, 7 and 7A are limited to using only the metal cap shapes in a longitudinal position as corner posts, and also would not adequately increase the thermal resistance over single wood material stud members, nor substantially reduce interior condensation and ghosting.

U.S. Pat. No. 5,285,615 to Gilmour describes a thermal metallic building stud. However, the Gilmour member is entirely formed from metal. In Gilmour, the thermal conductivity is only partially reduced by having raised dimples on the ends contacting other building materials.

U.S. Pat. No. 4,466,225 to Hovind describes a "stud extenders", title, that is limited to converting a "2×4 . . . into a 2×6", abstract. However, Hovind is limited to putting their metal side "extender" on one side of a "2×4", and thus would not adequately increase the thermal resistance over single wood material stud members, nor have a greater axial load capability over single wood material stud members, nor substantially reduce interior condensation and ghosting.

U.S. Pat. No. 3,960,637 to Ostrow describes impractical metal and wood composites. Ostrow requires each end flange have tapered channels, the end flanges being formed from extruded aluminum, molded plastic and fiberglass. Ends of the vertical wood web must be fit and pressed into a tapered channel. Besides the difficulty of aligning these parts together, other inherent problems exist. Extruding the channel flanges from aluminum or using molds, cuts and rolling to create the channelled plastic and fiberglass end flanges is expensive to manufacture. To stabilize the structures. Ostrow describes additional labor and manufacturing costs of gluing members together and sandwiching mounting blocks on the outsides of each channel.

Other metal and wood framing member patents of related but less significant interest include: U.S. Pat. No. 5,452,556 to Taylor: U.S. Pat. No. 5,440,848 to Deffet: U.S. Pat. No. 5,072,547 to DiFazio: U.S. Pat. No. 5,024,039 to Karhumaki: U.S. Pat. No. 4,875,316 to Johnston: U.S. Pat. No. 4,301,635 to Neufeld: U.S. Pat. No. 4,274,241 to Lindal: U.S. Pat. No. 4,031,686 to Sanford: U.S. Pat. No. 3,566,569 to Coke et al.: U.S. Pat. No. 3,531,901 to Meechan: U.S. Pat. No. 3,310,324 to Boden.

SUMMARY OF THE INVENTION

The first objective of the present invention is to provide metal and wood composite wall stud that increases the total thermal resistance of a typical steel framed insulated wall section by some 43 percent and would eliminate interior condensation and "ghosting" for all but the coldest regions of the United States.

The second object of this invention is to provide metal and wood composite framing combinations that achieve a resource efficient and economic construction framing member. Metal is used for its high strength, and potentially lower cost and resource efficiency through recycling. Wood is used primarily for its lower thermal conductivity and for its availability as a renewable resource, and for its workability.

The third object of this invention is to provide metal and wood composite framing members that allow electricians to be able to route wires through walls in the same way they are accustomed to doing with solid framing lumber.

The fourth object of this invention is to provide metal and wood composite framing members that would be easy to manufacture.

The fifth object of this invention is to provide metal and wood composite framing members that have low sound conductivity compared to prior art steel framing members.

The sixth object of this invention is to provide metal and wood composite framing members that have reduced effects from flammability compared to all wood members.

The invention includes J-shaped, P-shaped, L-shaped, triangular shaped cross-sectional metal forms connected by a wood midsection, whereby the wood is fastened to the metal by machine pressing of the metal to wood, similar to the common truss plate, or by nails, staples, screws, or other mechanical fastening means, or by adhesive glue. The outward faces of the metal members can be pre-formed with longitudinal ridges such that the contact surface area to applied sheathings is reduced by about 90%.

Metal and wood composites are used to create framing members (studs and tracks, joists and bands, headers, rafters, and the like) for light-weight construction. Metal is utilized for its high strength, resistance to rot and insects, cost stability, and potentially lower cost through recycling. Wood is used primarily for its lower thermal conductivity, and availability. The metal components form the primary structure while wood, either solid or other engineered wood, provides some structure and a thermal break.

Metal and wood composite framing members can be used in place of conventional wood framing members such as: 2×4 and 2×6 wall studs, and 2×8, 2×10, 2×12 and other dimensions of roof rafters, floor joists and headers. The novel framing members can be used to replace conventional light-gauge steel framing to reduce thermal transmittance and sound transmission.

Further objects and advantages of this invention will be apparent from the following detailed description of a presently preferred embodiment which is illustrated schematically in the accompanying drawings.

DESCRIPTION OF THE PREFERRED EMBODIMENT

Figure 1A:
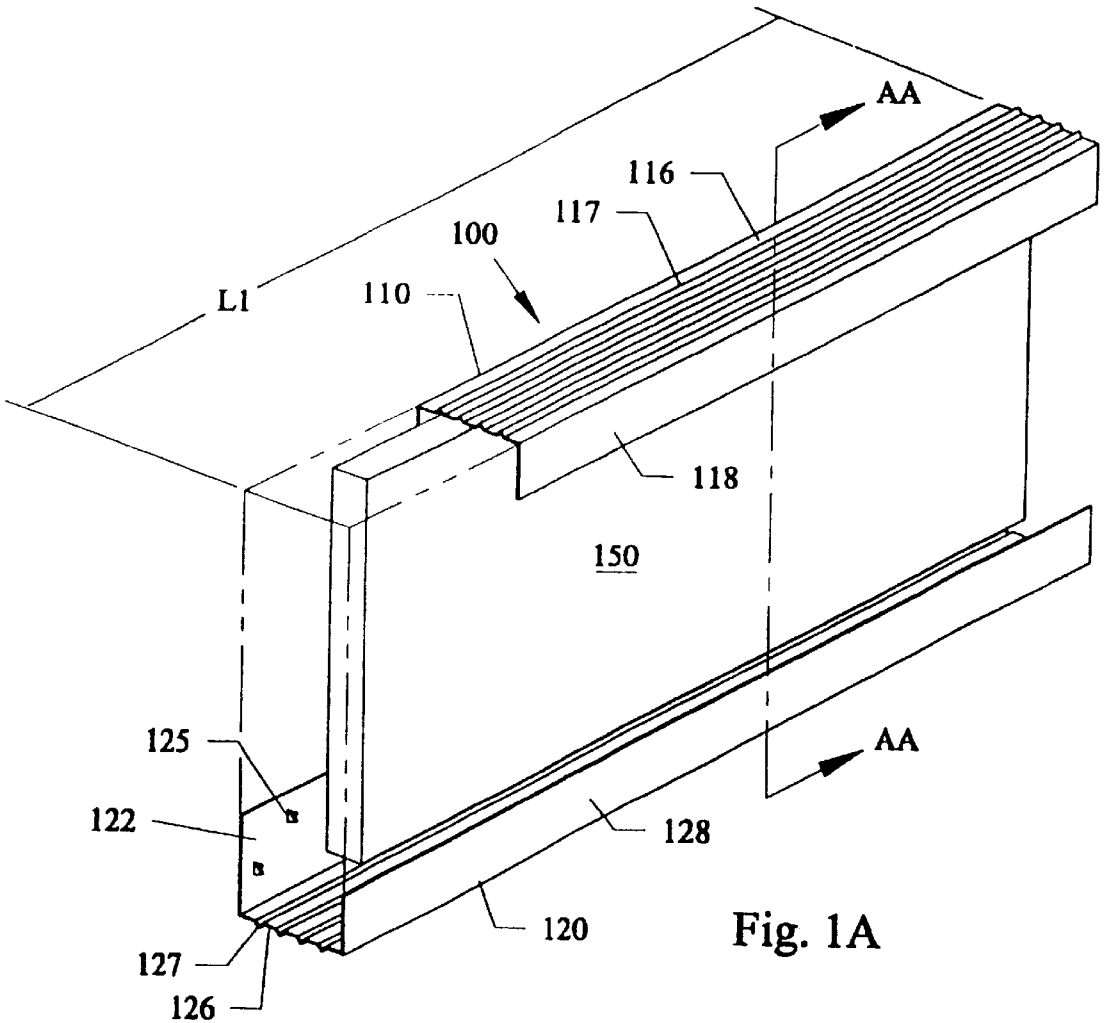
FIG. 1A is a perspective isometric view of a first preferred embodiment metal and wood stud.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The preferred method of calculating thermal transmittance for building assemblies with integral steel is the zone method published by the American Society of Heating Refrigeration and Air-Conditioning Engineers (ASHRAE). A recent study by the National Association of Home Builders Research Center and Oak Ridge National Laboratory verified the usefulness of the zone method for calculating thermal transmittance for light gauge steel walls.

Thermal transmittance calculations were completed using the zone method for the metal and wood stud invention embodiments. Table 1 shows a comparison of thermal transmittance (given as total R-value) for nine wall configurations. The first wall listed is a conventional 2×4 wood frame wall with ½" plywood sheathing and R-11 fiberglass cavity insulation. The total wall R-value is 13.2 hr-F-ft$^2$/Btu, the second and third walls listed are conventional metal stud walls, one with ½" plywood sheathing (R-7.9) and the other with ½" extruded polystyrene sheathing (R-11.4). With conventional metal studs, high resistivity insulated sheathings is necessary to limit the large loss of total thermal resistance when low resistivity sheathings are used. In some cases, it is not desirable to use the non-structural insulated sheathing, such as when brick ties are needed, or when higher racking resistance is needed.

In comparison, the metal and wood stud walls corresponding to those described in the subject invention has a 43 percent greater total R-value than the conventional metal stud wall when using plywood sheathing. Thermal performance of the metal and wood stud wall with plywood sheathing is nearly the same as the conventional wall with ½" extruded polystyrene (XPS insulated sheathing). Where non-structural sheathing is acceptable, fiber board sheathing, which is much less expensive than plywood, further increases the total R-value of the metal and wood stud wall.

TABLE 1

COMPARISON OF THERMAL TRANSMITTANCE FOR CONVENTIONAL METAL STUD WALL AND NOVEL METAL AND WOOD STUD WALL

| Description | Stud Size Inch | Stud Spacing Inch O.C. | Cavity Insulation | Exterior Sheathing | Total R-Value |
|---|---|---|---|---|---|
| 1. Conventional metal stud* | 1.625 × 3.625 | 24 | R-11 | ½" plywood | 7.9 |
| 2. Conventional metal stud* | 1.625 × 3.625 | 24 | R-11 | ½" XPS | 11.4 |
| 3. Novel metal and wood stud | 1.5 × 3.5 | 24 | R-11 | ½" plywood | 11.3 |
| 4. Novel metal and wood stud | 1.5 × 3.5 | 24 | R-13 | ½" plywood | 12.8 |
| 5. Novel metal and wood stud | 1.5 × 3.5 | 24 | R-15 | ½" plywood | 14.2 |
| 6. Novel metal and wood stud | 1.5 × 3.5 | 24 | R-11 | ½" fiber board | 12.1 |
| 7. Novel metal and wood stud | 1.5 × 3.5 | 24 | R-13 | ½" fiber board | 13.6 |
| 8. Novel metal and wood stud | 1.5 × 3.5 | 24 | R-15 | ½" fiber board | 15.0 |

*Conventional metal stud values from Thermodesign Guide for Exterior Walls, American Iron and Steel Institute, Washington, D.C., Pub. No. RG-9405, Jan. 1995.

Summary calculation results compared the allowable axial load for stud elements subjected to combined loading with axial and bending components. The three elements analyzed were a conventional 2×4 wood, a conventional 20 gauge steel stud, and the present invention metal and wood composite stud. All elements were 8' tall, and spaced 16" O.C. Wind (transverse) load at 110 mph. Table 2 shows that the metal and wood composite section can support 54% more weight than the metal stud, and 250% more weight than the wood stud. This gives the opportunity for further cost optimization by increasing the spacing which would reduce the number of studs required, or for reducing the amount of steel used in the composite section.

TABLE 2

STRUCTURAL CALCULATION RESULTS FOR NOVEL METAL AND WOOD

| STUD | 2 × 4 Wood Stud | 3.5" 20 Gauge Metal Stud | 3.5" Metal and wood Composite Section |
|---|---|---|---|
| Allowable Axial Load | | | |
| 8' tall stud 16" O.C. 110 mph wind | 551 lb | 894 lb | 1378 lb |

Comparison of vertical, transverse, and racking load capacities of 2×4 wood stud, metal stud, and subject invention wood/metal composite stud. Structural analysis by Kim McLeod, P.E. Of Keymark Enterprises, Boulder, Colo.

Figure 1B:
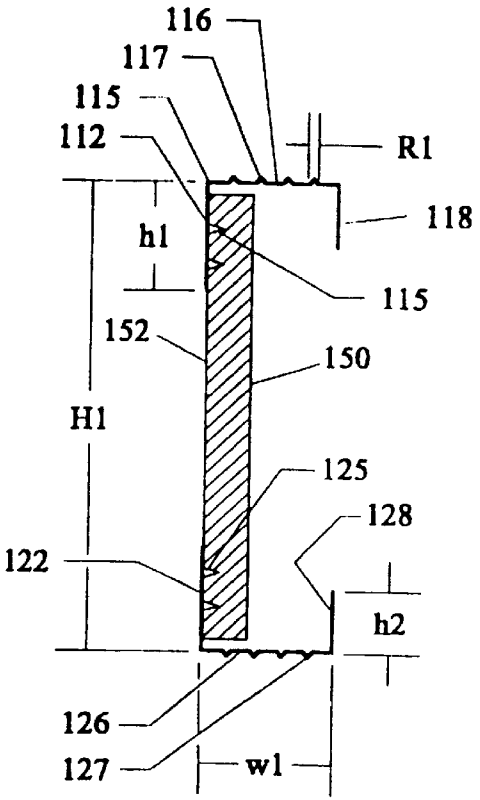
FIG. 1B is a cross-sectional view of the embodiment of FIG. 1A along arrow AA.

FIG. 1A is a perspective isometric view of a first preferred embodiment metal and wood stud 100. FIG. 1B is a cross-sectional view of the embodiment 100 of FIG. 1A along arrow AA. Referring to FIGS. 1A–1B, embodiment 100 includes metal forms 110, 120 such as but not limited to 20 gauge steel has been cold-formed in a roll press into a cross-sectional channel Jshape. Each form 110,120 includes steel web portions 112, 122 that have staggered rows of cutout portions 115, 125 which are of a pressed tooth type triangular shape. Web portions 112, 122 are perpendicular to flanges 116, 126 which include approximately 4 rows of raised V-shaped grooves 117, 127 running longitudinally along the exterior of the flanges 116, 126. Flanges returns 118, 128 are perpendicular to flanges 116, 126. Teeth 115, 125 can be hydraulically pressed adjacent the top and bottom rear side 152 of central web board 150. Central web board 150 can be solid wood, OSB, (oriented strand board) plywood and the like, having a thickness of approximately ½ an inch. Alternatively, web portions 112, 122 offorms 110, 120 can be fastened to the central web board 150 by nails, screws, staples and the like, or adhesively glued. A finished metal and wood s~d 100 can have a length, L L of approximately 8 feet or longer, height HI of approximately 3.5 to 5.5 inches, width WI of approximately 1.5 inches. Web portions 112, 122 can have a height, h1 of approximately 1.125 inches, front plate height, h2 of approximately 0.75 inches, raised grooves RI, of approximately 0.125 inches. A spacing, xI of approximately 0.125 inches separates each flange 116,126 from the top and bottom of central web board 150.

Figure 2A:
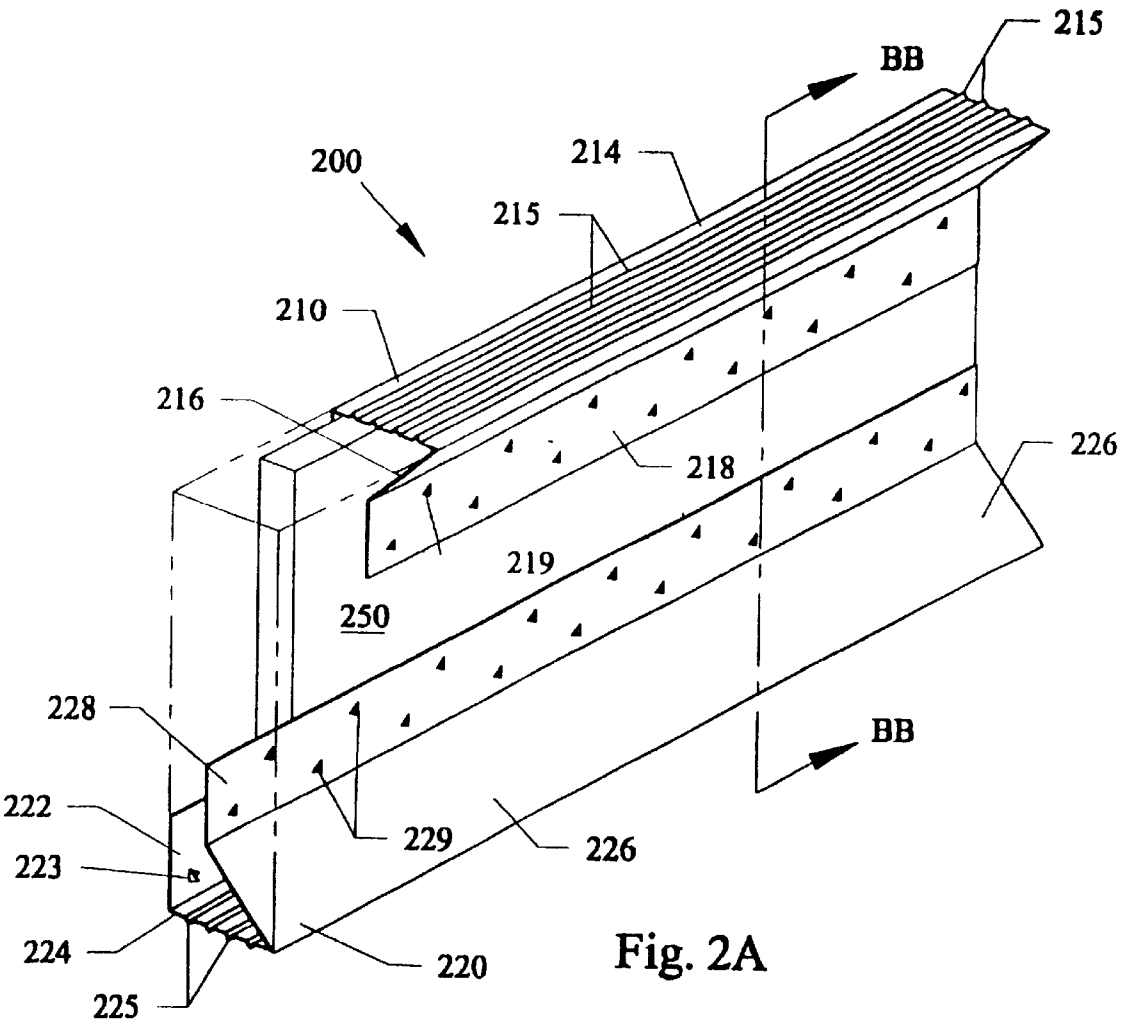
FIG. 2A is a perspective isometric view of a second preferred embodiment metal and wood stud.
Figure 2B:
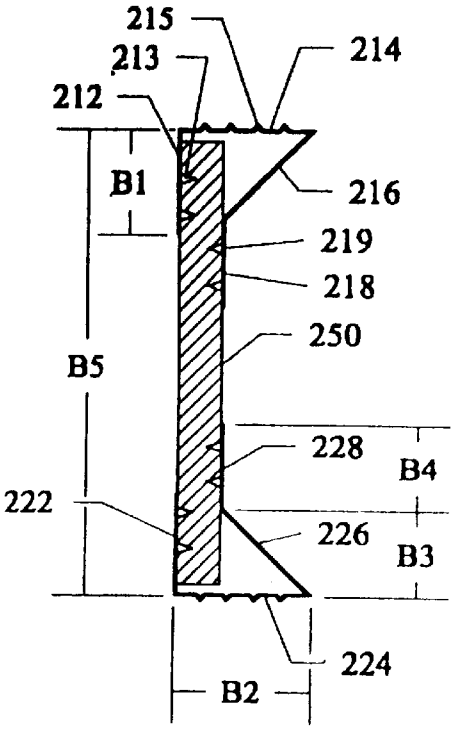
FIG. 2B is a cross-sectional view of the embodiment of FIG. 2A along arrow BB.

FIG. 2A is a perspective view of a second preferred embodiment metal and wood stud 200. FIG. 2B is a cross-sectional view of the embodiment 200 of FIG. 2A along arrow BB. Referring to FIGS. 2A–2B, embodiment 200 includes metal forms 210, 220 such as but not limited to 20 gauge steel that has been roll pressed into a cross-sectional channel right-triangular-shape. Each form 210, 220 includes outer web portions 212, 222 that have staggered rows of cut-out portions 213, 223 which are of a pressed tooth type triangular shape. Outer web portions 212, 222 are perpendicular to flanges 214, 224 which include approximately 4 rows of raised V-shaped grooves 215, 225 running longitudinally along their exterior surface. Flange returns 216, 226 are approximately 45 degrees to flanges 214, 224, and are connected to inner web portions 218, 228 each having staggered rows of cut-out portions 219, 229 which also are of the pressed tooth type triangular shape. Teeth 213, 219 and 223, 229 can be firmly pressed adjacent the top and bottom of central web board 250. Central web board 250 can be solid wood, OSB, plywood and the like, having a thickness of approximately ½ an inch. Alternatively, web portions 212, 218, 222, 228 can be fastened to the central web board 250 by nails, screws, staples and the like. Outer web portions 212, 222 can have a height, B1 of approximately 1.1625 inches, flanges 214, 224 can have a width, B2 of approximately 1.5 inches, flange returns 216, 226 can have a height, B3 of approximately 0.925 inches and inner web portions 218, 228 can have a height, B4 of approximately 1 inch. A finished metal and wood stud 200 can have the remaining dimensions and spacings similar to the embodiment 100 previously described, except height, B5 can be approximately 5.5 to approximately 7.25 inches.

Figure 3A:
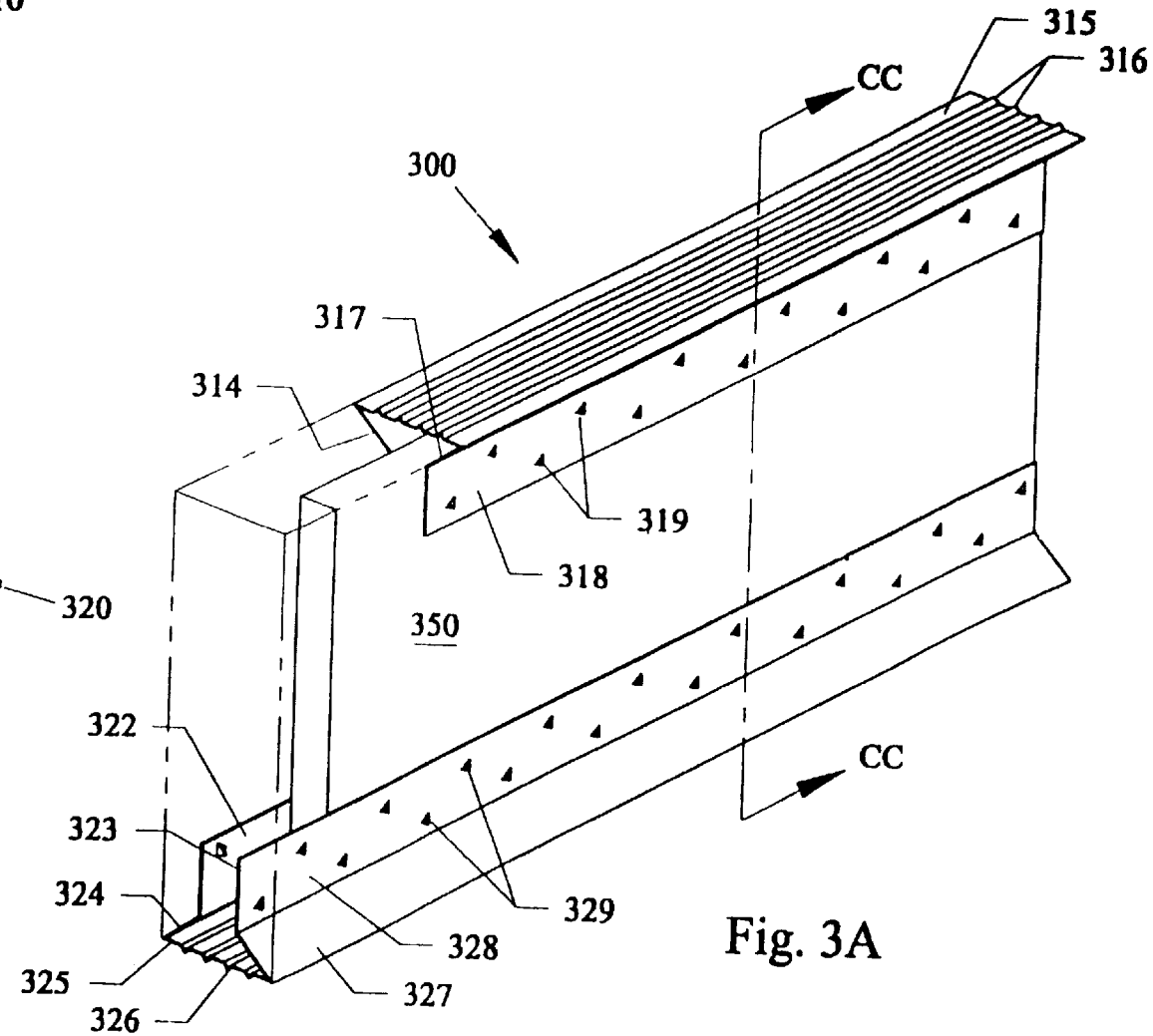
FIG. 3A is a perspective isometric view of a third preferred embodiment metal and wood stud.
Figure 3B:
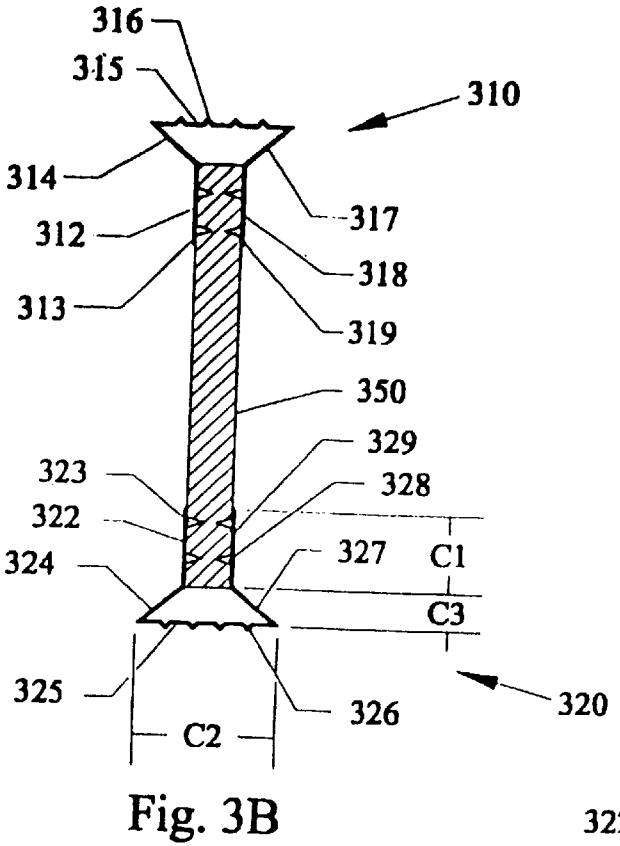
FIG. 3B is a cross-sectional view of the embodiment of FIG. 3A along arrow CC.

FIG. 3A is a perspective isometric view of a third preferred embodiment metal and wood stud 300. FIG. 3B is a cross-sectional view of the embodiment 300 of FIG. 3A along arrow CC. Referring to FIGS. 3A–3B, embodiment 300 includes metal forms 310, 320 such as but not limited to 20 gauge steel has been roll pressed into a cross-sectional channel triangular-shape with parallel plates on the apex of the triangle. Each form 310, 320 includes metal web portions 312, 322, 318, 328 that have staggered rows of cut-out portions 313, 323, 319, 329 which are of a pressed tooth type triangular shape. Web portions 312, 322, 318, 328 attach to 45 degree flange returns 314, 324 which are attached to respective flanges 315, 325 which include approximately 4 rows of raised V-shaped grooves 316, 326 running longitudinally along their exterior surface. Teeth 313, 319 and 323, 329 can be pressed adjacent the top and bottom of central web board 350. Central web board 350 can be solid wood, OSB, plywood and the like, having a thickness of approximately ½ an inch. Alternatively, metal web portions 312, 318, 322, 328 can be fastened to the central web board 350 by nails, screws, staples and the like. Metal web portions 312, 318, 322, 328 can have a height, C1 of approximately 0.875 inches, flanges 315, 325 can have a width, C2 of approximately 1.5 inches, flange returns 314, 317, 324, 327 can have a height, C3 of approximately 0.4625 inches. A finished metal and wood stud 300 can have remaining dimensions and spacings similar to the embodiment 200 previously described.

Figure 4A:
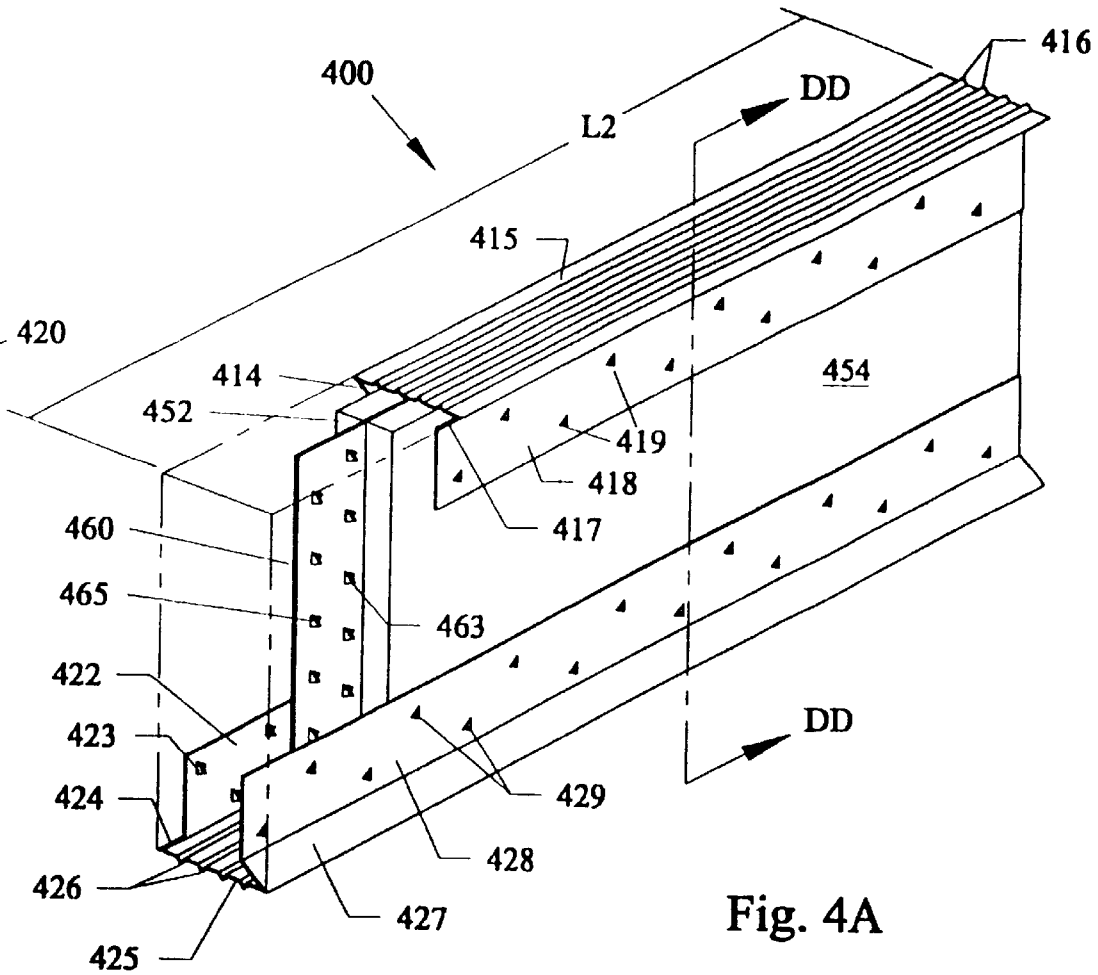
FIG. 4A is a perspective isometric view of a fourth preferred isometric view of a fourth preferred embodiment metal and wood joist, rafter and header.
Figure 4B:
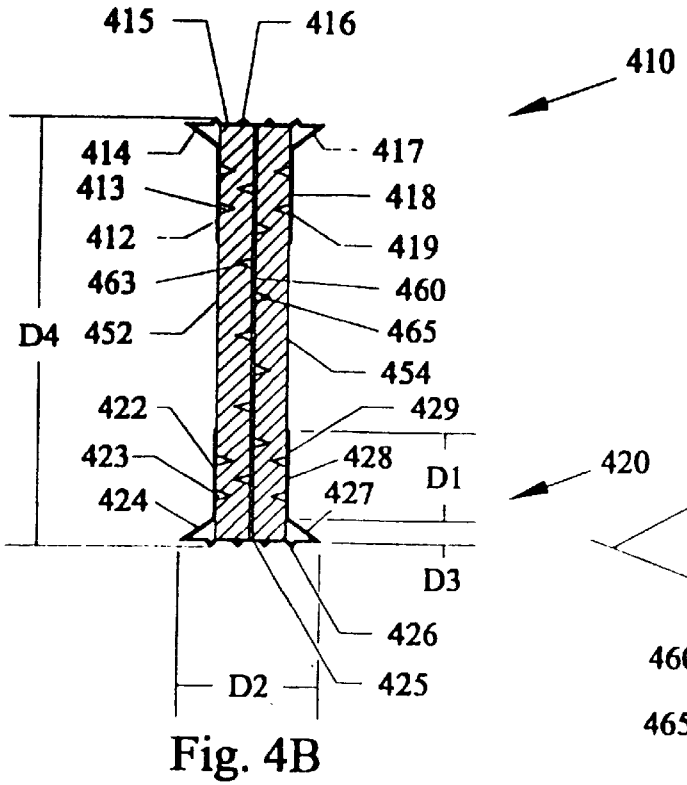
FIG. 4B is a cross-sectional view of the embodiment of FIG. 4A along arrow DD.

FIG. 4A is a perspective isometric view of a fourth preferred embodiment 400 useful as a metal and wood joist, rafter and header. FIG. 4B is a cross-sectional view of the embodiment 400 of FIG. 4A along arrow DD. Referring to FIGS. 4A–4B, embodiment 400 includes metal forms 410, 420 such as but not limited to 20 gauge steel has been roll pressed into a cross-sectional channel triangular-shape with parallel plates on the apex of the triangle. Each form 410, 420 includes metal web portions 412, 422, 418, 428 that have staggered rows of cut-out portions 413, 423, 419, 429 which are of a pressed tooth type triangular shape. Metal web portions 412, 422, 418, 428 attach to 45 degree flange returns 414, 424, 417, 427 which are attached to respective flanges 415, 425 which include approximately 4 rows of raised V-shaped grooves 416, 426 running longitudinally along their exterior surface. Teeth 413, 419 and 423, 429 can be pressed adjacent the top and bottom portions of central web boards 452, 454. A central metal plate 460 has left facing tooth rows 463 and right facing tooth rows 465 for connecting to adjacent respective web boards 452, 454. Plate 460 has a spacing above and below to separate such from flanges 415, 425. Central web boards 452, 454 can be solid wood, OSB, plywood and the like, having a thickness of approximately 0.375 inches. Alternatively, metal web portions 412, 418, 422, 428 can be fastened to the central web boards 452, 454 by nails, screws, staples and the like. Metal web portions 412, 418, 422, 428 can have a height, D1 of approximately 1.0188 inches, flanges 415, 425 can have a width, D2 of approximately 1.5 inches, flange returns 414, 417, 424, 427 can have a height, D3 of approximately 0.3188 inches. A finished embodiment 400 can have practically any length, L2 to serve as a floor joist, rafter or header, width D2 can be approximately 1.5 inches and height D4, can be approximately 5.5 inches or more.

Figure 5C:
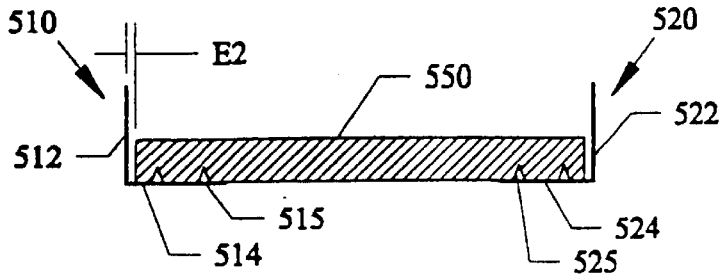
FIG. 5C is a cross-sectional view of the embodiment of FIG. 5B along arrow EE.
Figure 5A:
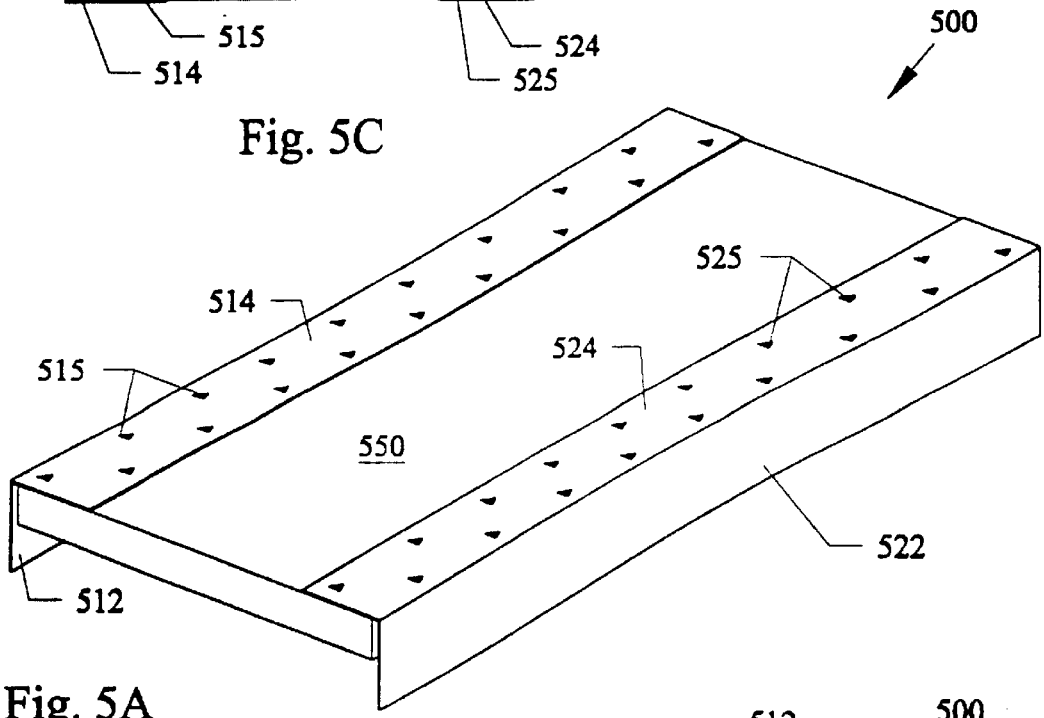
FIG. 5A is a top perspective view of a fifth embodiment track for metal and wood stud systems.
Figure 5B:
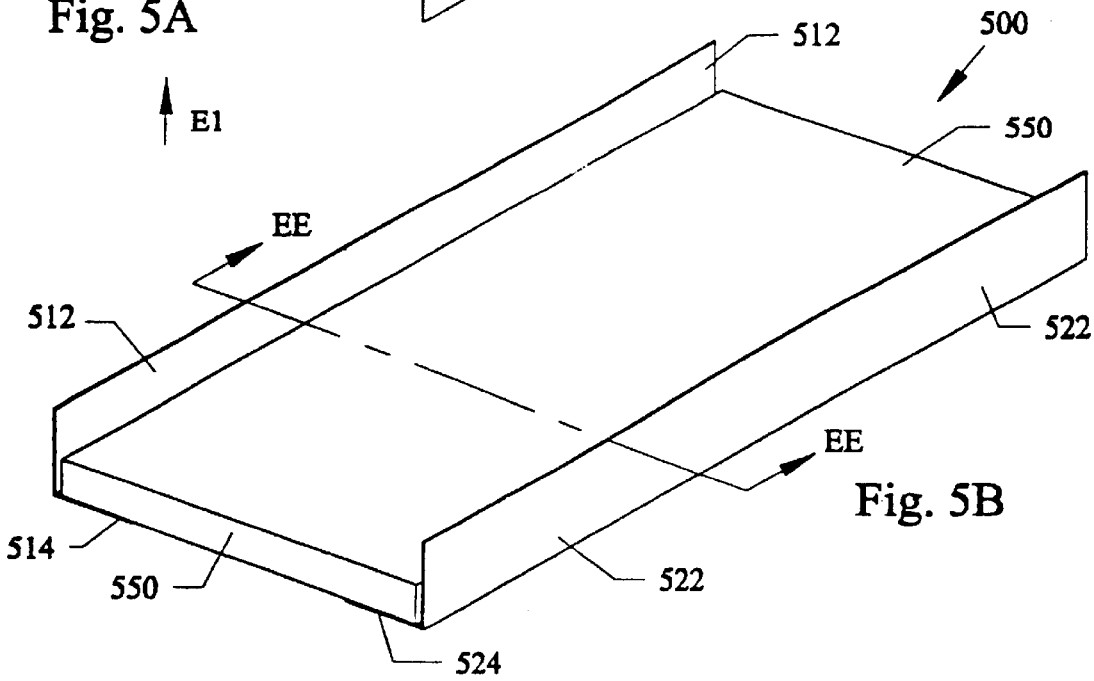
FIG. 5B is a bottom view of the embodiment of FIG. 5A along arrow EI.

FIG. 5A is a top perspective view of a fifth embodiment track 500 for metal and wood stud and track systems. FIG. 5B is a bottom perspective view of the embodiment 500 of FIG. 5A along arrow E1. FIG. 5C is a cross-sectional view of the embodiment 500 of FIG. 5B along arrow EE. Referring to FIGS. 5A–5C, embodiment 500 includes metal forms 510, 520 each having a generally L-shaped cross-section. Forms 510, 520 each include flanges 512, 522 approximately 1.125 inches in height perpendicular to metal web portions 514, 524, which are approximately 1.1625 inches in length. Metal web portions 514, 524 have tooth shaped triangular cut-outs 515, 525, which are pressed into sides of center-web-board 550. A spacing E2 of approximately 0.125 inches separates the ends of center-web-board 550 from flanges 512, 522, respectively. A finished embodiment 500 can have remaining dimensions and spacings similar to the embodiments 100, 200, and 300 above.

Figure 6B:
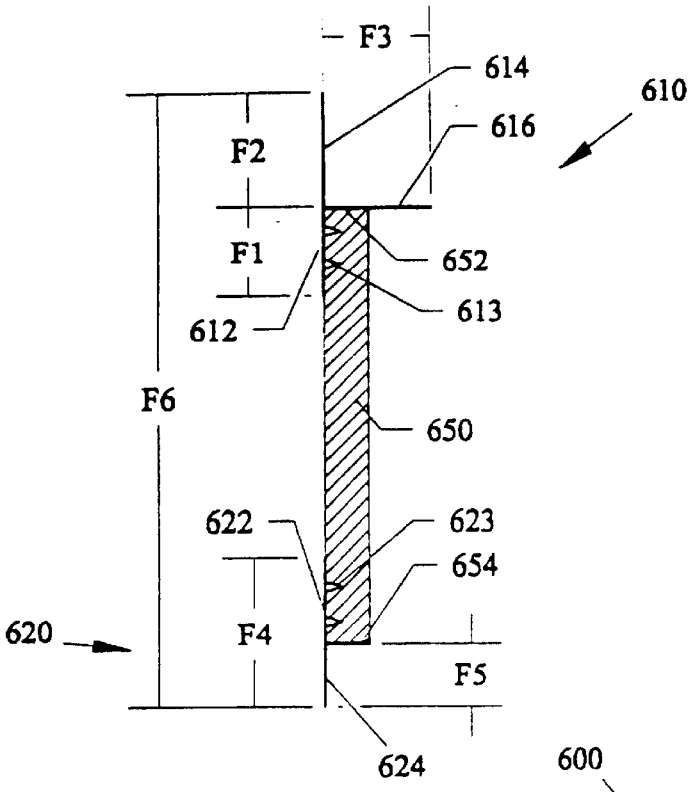
FIG. 6B is a cross-sectional view of the embodiment of FIG. 6A along arrow FF.
Figure 6A:
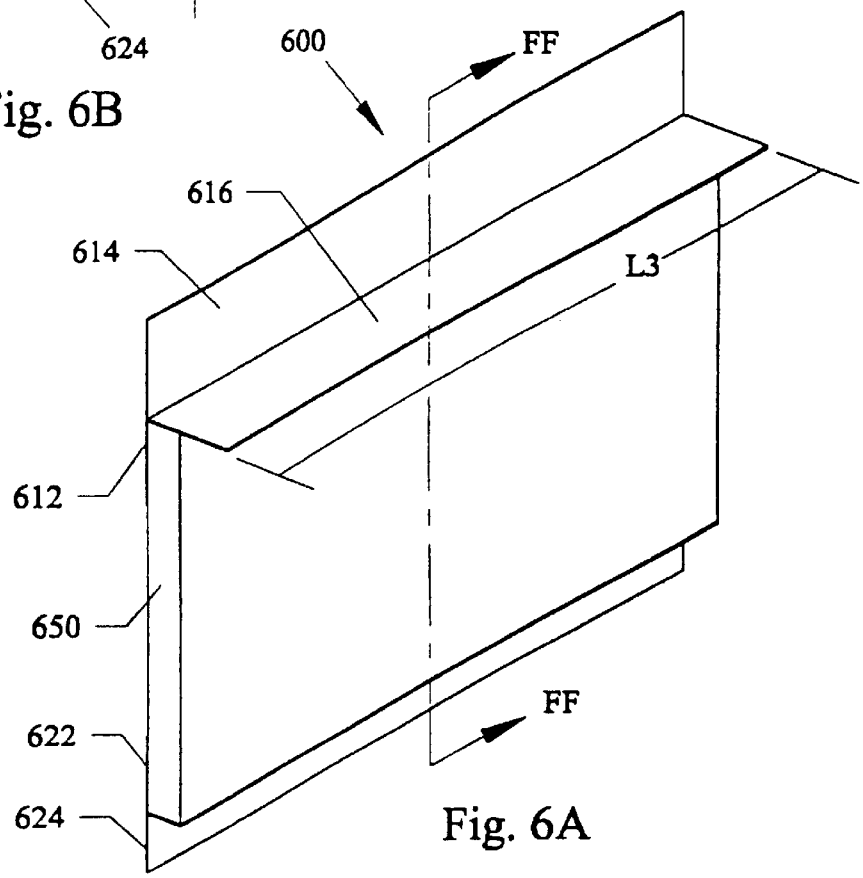
FIG. 6A is a perspective view of a sixth preferred embodiment metal and wood band.

FIG. 6A is a perspective view of a sixth preferred embodiment metal and wood joists and bands 600. FIG. 6B is a cross-sectional view of the embodiment 600 of FIG. 6A along arrow FF. Referring to FIGS. 6A–6B, embodiment 600 includes top metal form 610 having a T-cross-sectional shape and lower metal form 620 having a straight line cross-sectional shape. Form 610 includes metal web portion 612, having a length, F1 of approximately 1.0375 inches having tooth shaped triangular cut-outs 613 which are pressed into upper end sides of wood center web board 650. Form 610 further includes an upright leg 614 having a length F2 of approximately 1.3 inches, perpendicular to a third leg 616, having a length, F3 of approximately 1.25 inches, which abuts against and overlaps top end 652 of centerboard 650. Lower metal form 620 has a metal web portion 622 having tooth shaped triangular cut-outs 623 which are pressed into upper end sides of wood center board 650, and a continuous extended plate 624. The continuous width F4, of metal plate 622, 624 is approximately 1.75 inches, with plate 624 extending a length F5 of approximately 0.75 inches from the lower end 654 of center-web-board 650 having thickness of approximately 0.5 inches. A finished embodiment 600 can have a width F6 and length L3 similar to embodiment 400.

Figure 7:
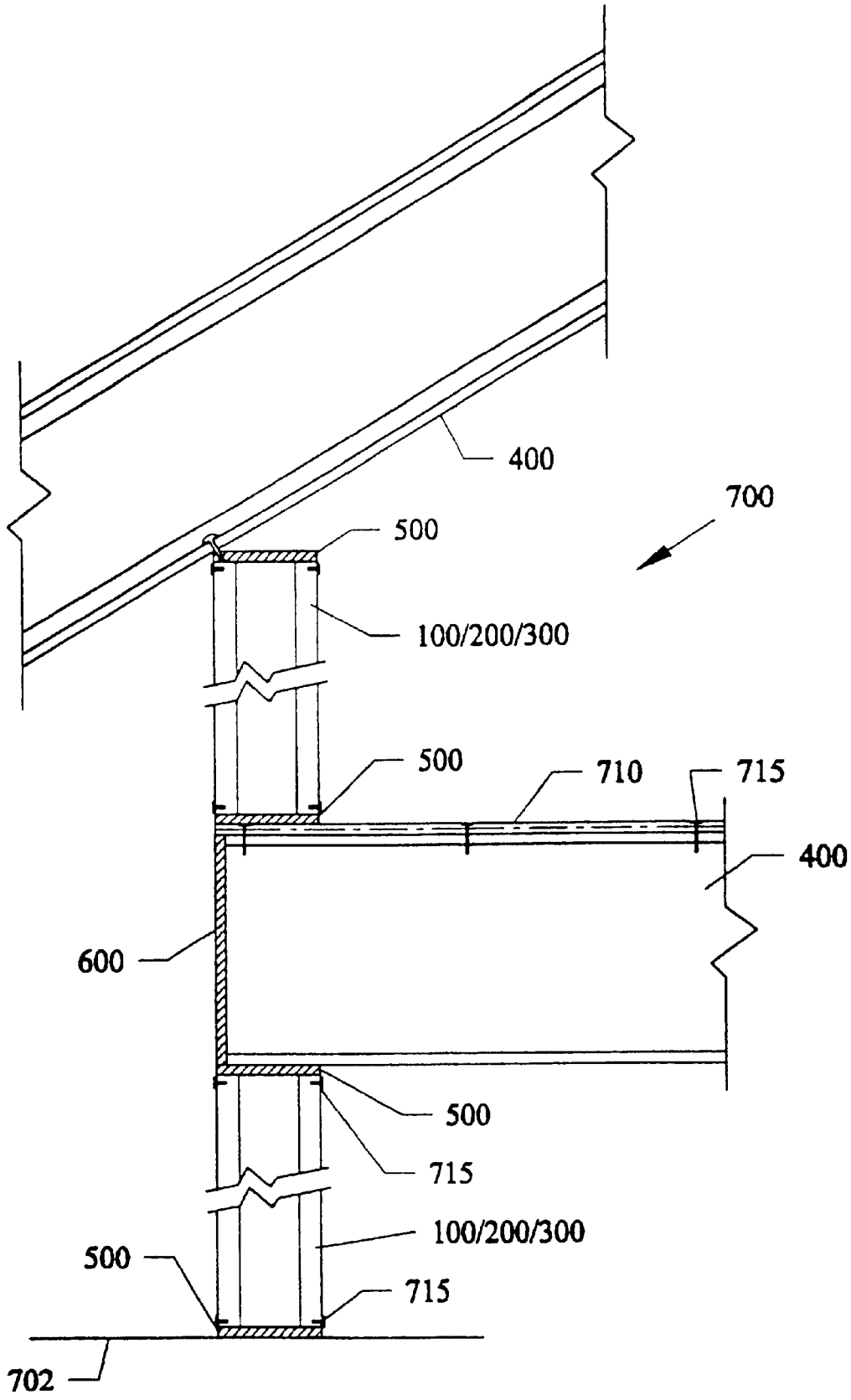
FIG. 7 is a cross-sectional view a framing system utilizing the embodiments of FIGS. 1A–6B.

FIG. 7 is a cross-sectional view a framing system 700 utilizing the embodiments of FIGS. 1A–6B. Embodiment 700 can be a two story building having a metal and wood bottom track 500 attached at floor 702 by conventional fasteners such as nails, screws, bolts and the like. Vertically oriented metal and wood studs 100/200/300 can be attached to floor and ceiling tracks 500 by steel framing screws 715 and the like. A metal and wood band 600 attaches first floor ceiling track 500 to metal and wood floor joist 400 and subfloor 710, which has conventional steel framing flathead type screws 716 and the like. The second floor has a similar arrangement with rafters 400 attached at conventional angles to upper metal and wood top track 500.

A cost of a metal and wood composite stud such as those described in the previous embodiment 100 is estimated to be $4.24. The lowest cost of conventional 20 gauge steel studs is $2.52 each, however, to obtain the same thermal performance, an insulated sheathing is required which raises the cost to $4.55 per stud. The metal and wood framing member's invention is directly cost effective compared to the conventional metal stud. In addition, structural calculations show that the metal and wood stud configuration can support 54% more weight at the same 8' wall height, 16" O.C. spacing, and 110 mph wind load. This give opportunity for further cost optimization by increasing the spacing which would reduce the number of studs required. For example, a 2000 square foot house framed 16" O.C. will have about 168 conventional steel exterior wall studs, the same house framed 24" O.C. with the stronger metal and wood composite exterior wall studs will use only 107 studs. With 61 fewer exterior wall studs required, the builder can save about $270.

Metal-Wood Stud Adhesive Pocket Configuration

Figure 8A:
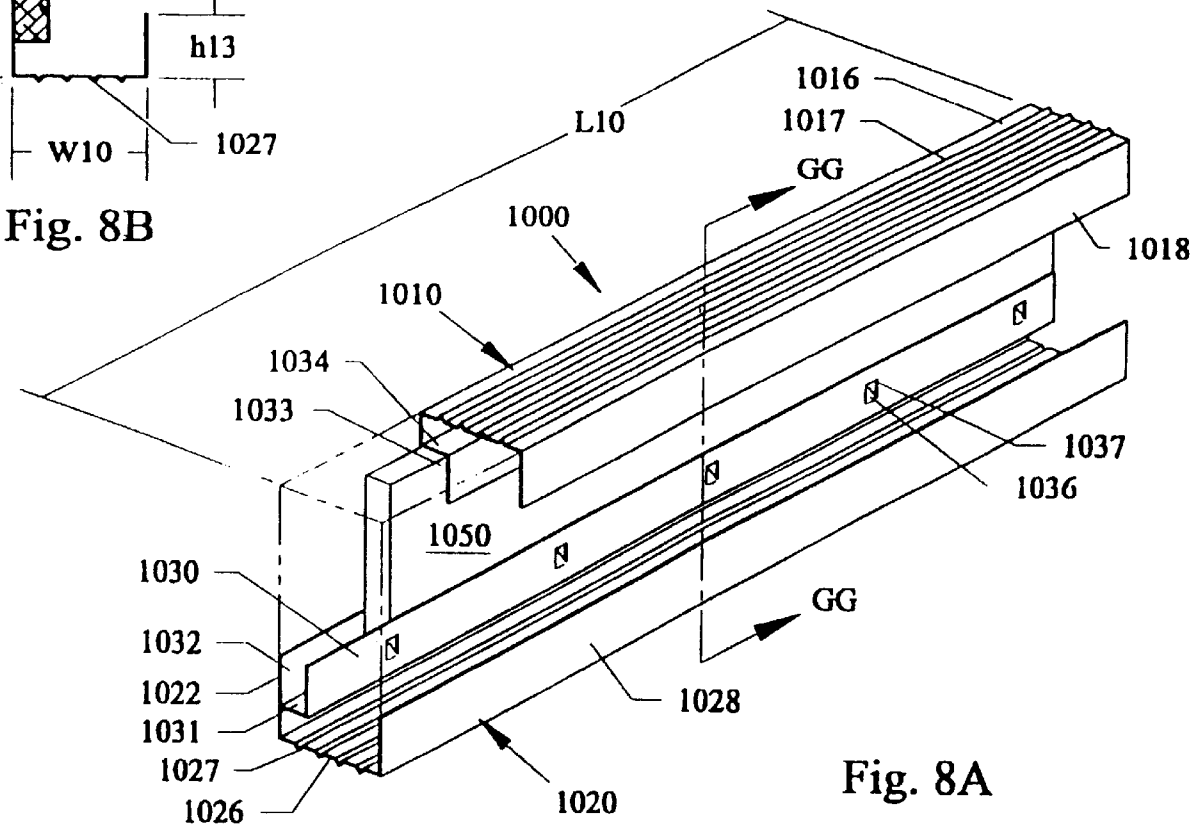
FIG. 8A is a perspective view of a seventh preferred embodiment metal-wood stud.
Figure 8B:
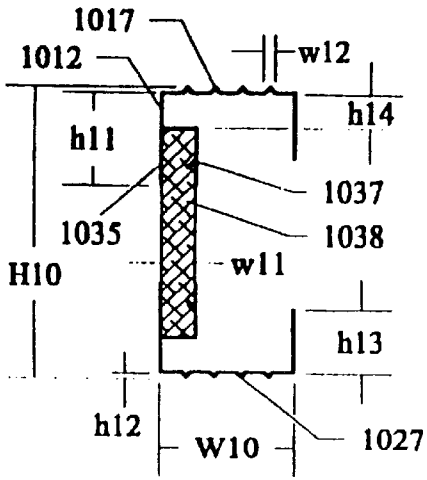
FIG. 8B is a cross-sectional view of the embodiment of FIG. 8A along arrow GG.
Figure 8C:
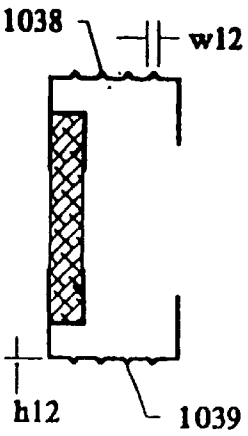
FIG. 8C is another cross-sectional view of FIG. 8A along arrow GG with circular ridges.

FIG. 8A is a perspective view of a seventh preferred embodiment metal-wood stud 1000. FIG. 8B is a cross-sectional view of the embodiment 1000 of FIG. 8A along arrow GG. Referring to FIGS. 8A–8C, embodiment 1000 includes metal forms 1010, 1020 such as but not limited to 20 gauge galvanized steel that has been cold-formed into a cross-sectional channel J-shape with integral U-shape. Each form 1010, 1020 includes metal web portions 1012, 1022. Metal web portions 1012, 1022 are perpendicular to flanges 1016, 1026 which may include approximately four rows of V-shaped ridges 1017, 1027, or approximately four rows of semi-circular ridges 1038, 1039 running longitudinally along the exterior of the flanges 1016, 1026. Lip portions 1018, 1028 are perpendicular to flanges 1016, 1026. Integral U-shaped adhesive pockets are made up of portions 1030, 1031, 1032, 1033, 1034, 1035. Central web board 1050 can be OSB (oriented strand board), plywood, solid wood, plastic, fiber reinforced plastic, fiber reinforced cementitious material and the like, having thickness of approximately ⅜ to approximately ½ inch. Adhesive pocket portions 1030, 1031, 1032, 1033, 1034, 1035 can be adhesively fastened to the central web board 1050 and metal tabs 1036, 1037, pressed from metal web portions 1012, 1022 and adhesive pocket portions 1030, 1032, 1033, 1035 protrude into central web board 1050 in such a way as to keep the central web board from withdrawing from the adhesive pockets. Alternatively, adhesive pocket portions 1030, 1031,1032, 1033, 1034,1035 can be mechanically fastened to the central web board 1050 by screws, nails, rivets, pins and the like. A finished metal-wood stud 1000 can have a length, L10, of approximately 8 feet or longer, height h10 of approximately 3.5 to approximately 5.5 inches, and width w10 of approximately 1.5 inches. Metal web portions 1012, 1022 can have a height, h11, of approximately 1.125 inches, lip height, h13, of approximately 0.75 inches, raised grooves height, h12, of approximately 0.0625 inches, raised grooves width, w12, of approximately 0.125 inches. A spacing, h14, of approximately 0.375 inches separates each flange 1016, 1026 from the adhesive pocket portions 1031, 1034. Adhesive pocket portions 1031, 1034 can have a width, w11, of approximately 0.375 to approximately 0.5 inches to match the thickness of central web board 1050.

Metal-Wood Top and Bottom Track Adhesive Pocket Configuration

Figure 9B:
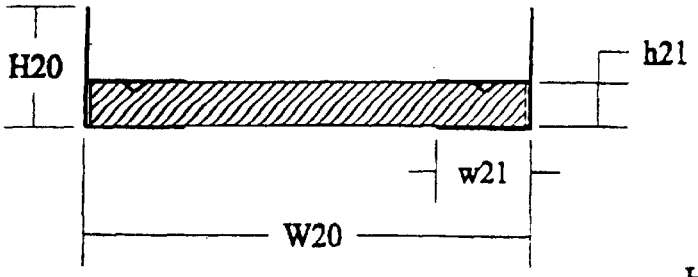
FIG. 9B is a cross-sectional view of the embodiment of FIG. 9A along arrow HH.
Figure 9C:
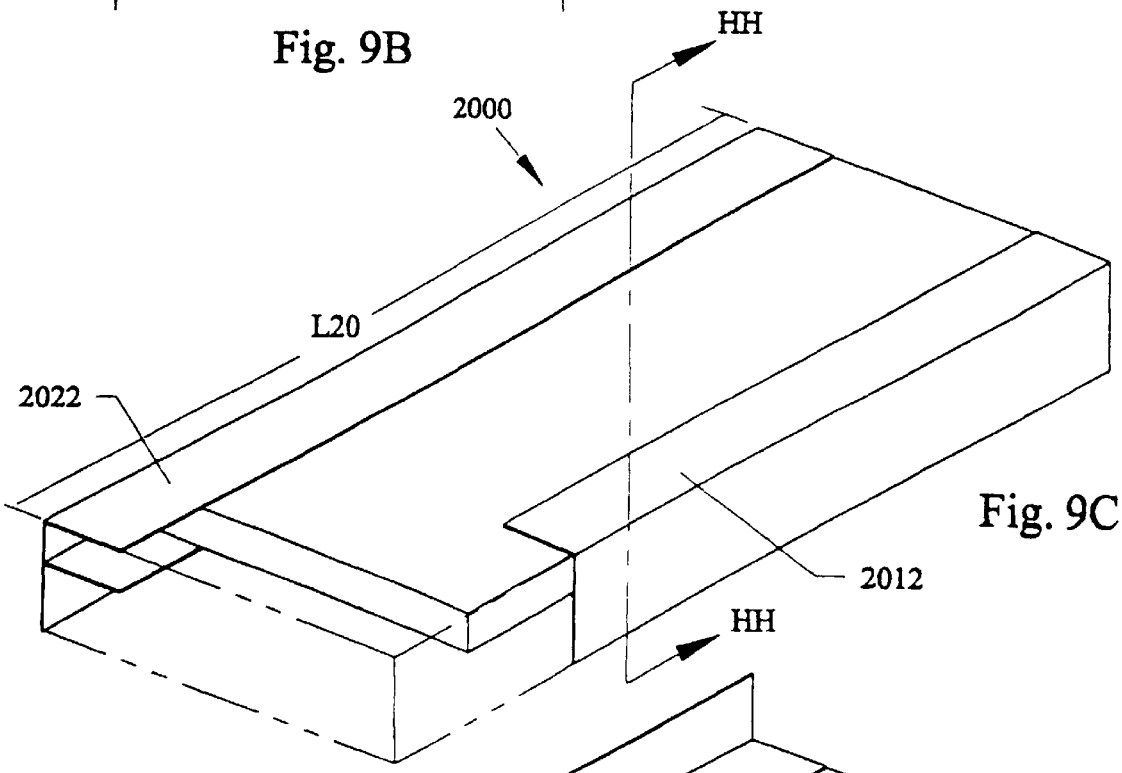
FIG. 9C is a bottom view of the top metal-wood top and bottom track of FIG. 9A.
Figure 9A:
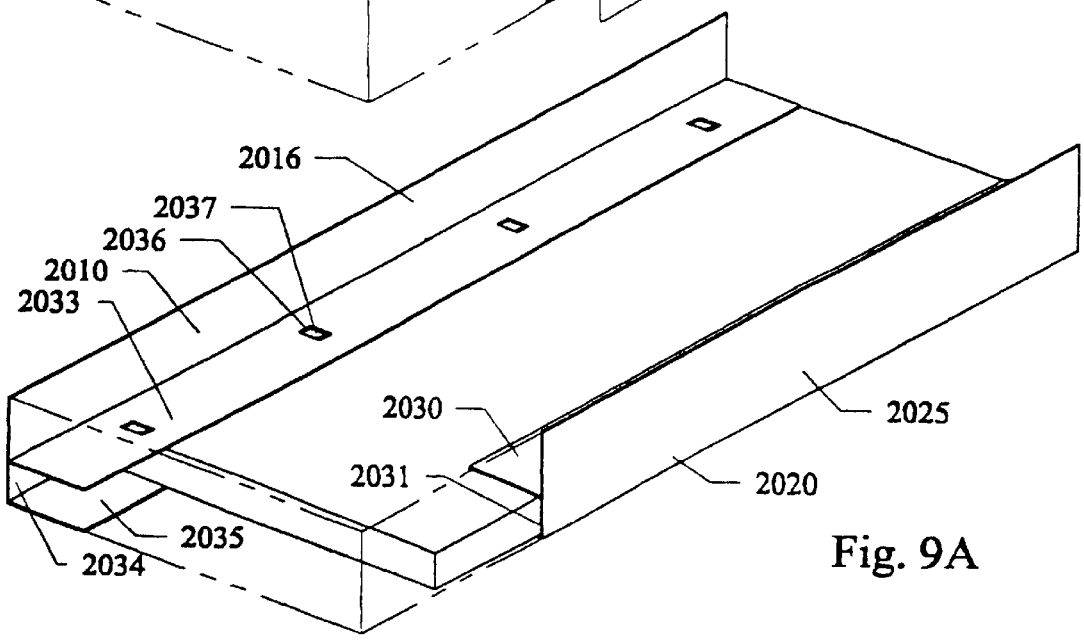
FIG. 9A is a top view of a eigth preferred embodiment metal-wood top and bottom track.

FIG. 9A is a top perspective view of an eigth preferred embodiment metal-wood top and bottom track 2000. FIG. 9C is a bottom perspective view of metal-wood top and bottom track 2000. FIG. 9B is a cross-sectional view of the embodiment 2000 of FIG. 9A along arrow HH. Referring to FIGS. 9A–9B, embodiment 2000 includes metal forms 2010, 2020 such as but not limited to 20 gauge galvanized steel that has been cold-formed into a cross-sectional channel L-shape with integral U-shape. Each form 2010, 2020 includes metal web portions 2012, 2022. Metal web portions 2012, 1022 are perpendicular to flanges 2016, 2026. Integral U-shaped adhesive pockets are made up of portions 2030, 2031, 2032, 2033, 2034, 2035. Central web board 2050 can be OSB (oriented strand board), plywood, solid wood, plastic, fiber reinforced plastic, fiber reinforced cementitious material and the like, having thickness of approximately ⅜ to approximately ½ inch. Adhesive pocket portions 2030, 2031, 2032, 2033, 2034, 2035 can be adhesively fastened to the central web board 2050 metal tabs 2036, 2037, pressed from metal web portions 2012, 2022 and adhesive pocket portions 2030, 2032, 2033, 2035, protrude into central web board 2050 in such a way as to keep the central web board from withdrawing from the adhesive pockets. Alternatively, adhesive pocket portions 2030, 2031, 2032, 2033, 2034, 2035 can be mechanically fastened to the central web board 2050 by screws, nails, rivets, pins and the like. A finished metal-wood track 2000 can have a length, L20, of approximately 8 feet or longer, height H20 of approximately 1.25 inches, and width W20 of approximately 3.5 to approximately 5.5 inches. Metal web portions 2012, 2022 can have a width, w21, of approximately 1.125 inches. Adhesive pocket portions 2031, 2034 can have a height, h21, of approximately 0.375 to approximately 0.5 inches to match the thickness of central web board 2050.

Metal-Wood Stud P-shape Configuration

Figure 10A:
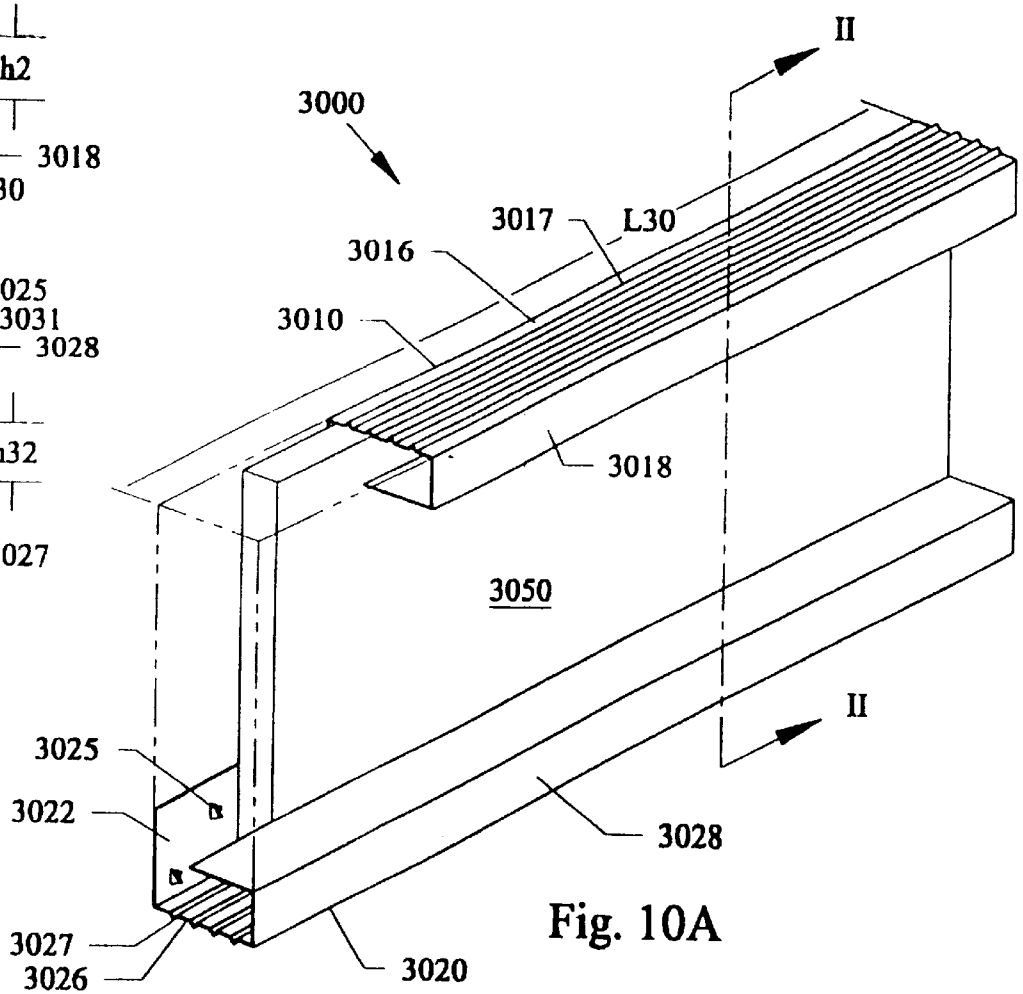
FIG. 10A is a perspective view of a ninth preferred embodiment metal-wood stud.
Figure 10B:
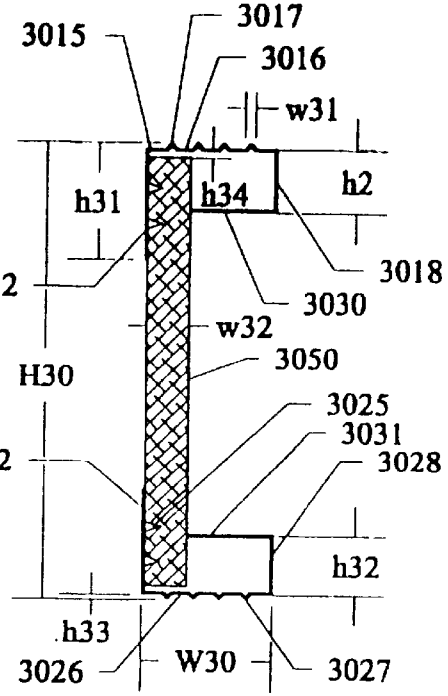
FIG. 10B is a cross-sectional view of the embodiment of FIG. 10A along arrow II.
Figure 10C:
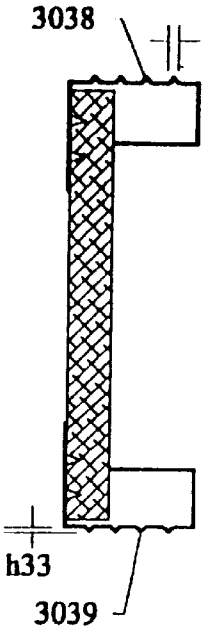
FIG. 10C is another cross-sectional view of FIG. 10A along arrow II with circular ridges.

FIG. 10A is a perspective view of a ninth preferred embodiment metal-wood stud 3000. FIG. 10B is a cross-sectional view of the embodiment 3000 of FIG. 10A along arrow II. Referring to FIGS. 10A–10B, embodiment 3000 includes metal forms 3010, 3020 such as but not limited to 20 gauge galvanized steel that has been cold-formed into a cross-sectional channel P-shape. Each form 3010, 3020 includes metal web portions 3012, 3022. Metal web portions 3012, 3022 are perpendicular to flanges 3016, 3026 which can include approximately four rows of V-shaped ridges 3017, 3027, or approximately four rows of semi-circular ridges 3038, 3039 (as shown in FIG. 10C) running longitudinally along the exterior of the flanges 3016, 3026. Lip portions 3018, 3028 are perpendicular to flanges 3016, 3026. Lip returns 3030, 3031 are perpendicular to lips 3018, 3028 and parallel to flanges 3016, 3026 and abut against central web board 3050 inhibiting the central web board 3050 from loosening from the metal web portions 3012, 3022. Central web board 3050 can be OSB (oriented strand board), plywood, solid wood, plastic, fiber reinforced plastic, fiber reinforced cementious material and the like, having a thickness of approximately ⅜ to approximately ½ inch. A finished metal-wood stud 3000 can have a length, L30 of approximately 8 feet or longer, height H30 of approximately 3.5 to approximately 5.5 inches, and width W30 of approximately 1.5 inches. Metal web portions 3012, 3022 can have a height, h31 of approximately 1.125 inches, lip height h2, of approximately 0.5 inches, raised grooves height h33 of approximately 0.0625 inches, raised grooves width, w31, of approximately 0.125 inches. A spacing, h34 of approximately 0.125 inches separates each flange 3016, 3026 from the central web board 3050.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A stud support member, the stud support member comprises:

a substantially vertically elongated web member having a first long end, a second long end opposite the first long end, a first short end and a second short end opposite the first short end, a first face and a second face opposite the first face, the web member formed from a first material;

a first form solely consisting of a first longitudinal flange adjacent to the first long end of the web member, the first flange being connected to the web member by a first U-shaped pocket for wrapping about a portion of both faces of the first long end of the web member, the first flange solely extending away from the web member; and a second form solely consisting of a second longitudinal flange adjacent to the second long end of the web member, the second flange being connected to the web member by a second U-shaped pocket for wrapping about a portion of both faces of the second long end of the web member, the second flange solely extending away from the web member, wherein the first flange and the second flange each extend away from the web member in the same direction, and the first form and the second form being formed from a second material, so that the first material and the second material are dissimilar from one another, thereby increasing the thermal resistance, axial load capability, and reducing interior condensation and ghosting.

2. The stud support member of claim 1, wherein the first form and the second form are formed from metal, and the web member is formed from a material selected from the group consisting of wood, plastic, cement or composite.

3. The stud support member of claim 1, wherein the first flange and the second flange each include: parallel rows of V-shaped ridges.

4. The stud support member of claim 1, wherein the first flange and the second flange each include: parallel rows of semi-circular rounded ridges.

5. A track support member formed from mixed composite materials which is used for residential and light construction, the track support member comprises:

a substantially elongated web member having a first long end, a second long end opposite the first long end, a first short end and a second short end opposite the first short end, a first face and a second face opposite the first face, the web member being formed from a first material;

a first form consisting of a first longitudinal flange adjacent to the first long end of the web member, the first flange having a first long end and a second long end opposite the first long end, a first short end and a second short end opposite the first short end, the first long end of the first flange being connected to the web member by a first U-shaped pocket for wrapping about a portion of both faces of the first long end of the web member, the second long end solely extending away from the web member; and a second form consisting of a second longitudinal flange adjacent to the second long end of the web member, the second flange having a first long end and a second long end opposite the first long end, a first short end and a second short end opposite the first short end, the first long end of the second flange being connected to the web member by a second U-shaped pocket for wrapping about a portion of both faces of the second long end of the web member, the second long end solely extending away from the web member, the second long end of the first flange and the second long end of the second flange each extending in the same direction, the first form and the second form being formed from a second material, so that the first material and the second material are dissimilar from one another, thereby increasing the thermal resistance, and reducing interior condensation and ghosting.

6. The track support member of claim 5, wherein a portion of the first flange abuts against the first long end of the web member, and a portion of the second flange abuts against the second long end of the web member.

7. The track support member of claim 5, wherein the first form and the second form are formed from metal, and the web member is formed from a material selected from the group consisting of wood, plastic, cement or composite.

8. The track support member of claim 5, wherein the first flange and the second flange each include: parallel rows of V-shaped ridges.

9. The stud support member of claim 5, wherein the first flange and the second flange each include: parallel rows of semi-circular rounded ridges.

10. A building member, comprising:

a substantially elongated web member having a first long end, a second long end opposite the first long end, a first short end and a second short end opposite the first short end, a first face and a second face opposite the first face, the web member formed from a first material;

a first form consisting of a first longitudinal flange adjacent to the first long end of the web member, the first flange having a first long end and a second long end opposite the first long end, a first short end and a second short end opposite the first short end, the first long end of the first flange being attached by a U-shaped pocket to a portion of both faces the first long end of the web member, the second long end of the first flange solely extending away from the web member; and a second form consisting of a second longitudinal flange adjacent to the second long end of the web member, the second flange having a first long end and a second long end opposite the first long end, a first short end and a second short end opposite the first short end, the first long end of the second flange being attached to by a U-shaped pocket to a portion of both faces of the second long end of the web member, the second end of the second flange solely extending away from the web member, the second long end of the first flange and the second long end of the second flange each extending in the same direction.

11. The building member of claim 10, wherein a portion of the first flange abuts against the first long end of the web member, and a portion of the second flange abuts against the second long end of the web member.

12. The building member of claim 10, wherein the first form and the second form are formed from metal, and the web member is formed from a material selected from the group consisting of wood, plastic, cement or composite.

13. The building member of claim 10, wherein the first flange and the second flange each include: parallel rows of V-shaped ridges.

14. The building member of claim 10, wherein the first flange and the second flange each include: parallel rows of semi-circular rounded ridges.

* * * * *

UNITED STATES PATENT AND TRADEMARK OFFICE

CERTIFICATE OF CORRECTION

PATENT NO. : 6,516,584 B1
DATED : February 11, 2003
INVENTOR(S) : Armin Rudd

It is certified that error appears in the above-identified patent and that said Letters Patent is hereby corrected as shown below:

Title page,
Insert:
-- [74] *Attorney, Agent, or Firm,* Brian S. Steinberger
Law Offices of Brian S. Steinberger, P.A. --

Signed and Sealed this

Seventeenth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,516,584 B1
DATED : February 11, 2003
INVENTOR(S) : Armin Rudd

It is certified that error appears in the above-identified patent and that said Letters Patent is hereby corrected as shown below:

Title page,
Insert Item -- [73] Assignee: University of Central Florida
Orlando, Florida --

Insert Item -- [74] *Attorney, Agent or Firm*—Brian S. Steinberger, Law Offices of Brian S. Steinberger, P.A. --

Signed and Sealed this

Tenth Day of February, 2004

JON W. DUDAS
*Acting Director of the United States Patent and Trademark Office*